US008720097B2

(12) United States Patent
Derman

(10) Patent No.: US 8,720,097 B2
(45) Date of Patent: May 13, 2014

(54) TRIGGER LOCK

(76) Inventor: Jay S Derman, Temecula, CA (US)

( * ) Notice: Subject to any disclaimer, the term of this patent is extended or adjusted under 35 U.S.C. 154(b) by 0 days.

(21) Appl. No.: 13/608,393

(22) Filed: Sep. 10, 2012

(65) Prior Publication Data

US 2013/0061502 A1 Mar. 14, 2013

Related U.S. Application Data

(60) Provisional application No. 61/533,246, filed on Sep. 11, 2011.

(51) Int. Cl.
*F41A 17/02* (2006.01)
*F41A 17/54* (2006.01)

(52) U.S. Cl.
USPC ..... 42/70.07; 42/70.11

(58) Field of Classification Search
USPC ..... 42/70.07, 70.11, 70.01, 70.06
See application file for complete search history.

(56) References Cited

U.S. PATENT DOCUMENTS

| | | | | | |
|---|---|---|---|---|---|
| 1,686,482 | A | * | 10/1928 | Windle | 42/70.07 |
| 1,887,308 | A | * | 11/1932 | Jessup | 42/70.06 |
| 2,664,658 | A | * | 1/1954 | Bjorklund | 42/70.06 |
| 2,882,636 | A | * | 4/1959 | Shinaver | 42/70.06 |
| 3,031,787 | A | * | 5/1962 | Womble, Jr. | 42/70.01 |
| 3,164,919 | A | * | 1/1965 | Hall | 42/70.06 |
| 3,392,471 | A | * | 7/1968 | Foote | 42/70.06 |
| 3,422,560 | A | * | 1/1969 | Foote et al. | 42/70.06 |
| 3,616,559 | A | * | 11/1971 | Sobolewski | 42/70.06 |
| 3,664,163 | A | * | 5/1972 | Foote | 70/58 |
| 4,499,681 | A | * | 2/1985 | Bako et al. | 42/70.07 |
| 4,509,281 | A | * | 4/1985 | Dreiling et al. | 42/70.07 |
| 4,995,180 | A | * | 2/1991 | Tucker et al. | 42/70.07 |
| 5,012,605 | A | * | 5/1991 | Nishioka | 42/70.07 |
| 5,437,119 | A | * | 8/1995 | Womack | 42/70.07 |
| 5,535,537 | A | * | 7/1996 | Avganim | 42/70.07 |
| 5,544,440 | A | * | 8/1996 | Stockman | 42/70.07 |
| D375,342 | S | * | 11/1996 | Collins | D22/108 |
| 5,680,723 | A | * | 10/1997 | Ruiz | 42/70.11 |
| 5,918,402 | A | * | 7/1999 | Weinraub | 42/70.07 |
| 5,960,575 | A | * | 10/1999 | Chiovitt et al. | 42/70.07 |
| 6,128,847 | A | * | 10/2000 | Langner | 42/106 |
| 6,308,540 | B1 | * | 10/2001 | Lee | 70/58 |
| 8,186,087 | B2 | * | 5/2012 | Ogershok | 42/70.06 |
| 2002/0002784 | A1 | * | 1/2002 | Essex | 42/70.07 |

* cited by examiner

*Primary Examiner* — Jonathan C Weber
(74) *Attorney, Agent, or Firm* — Aaron P. McGushion

(57) ABSTRACT

A trigger lock is provided with a shield member having a U-shaped channel forming a first plate and a second plate spaced apart from the first flange, with a web connecting the first and second plates. The shield member has a peripheral contour that is complementarily shaped to closely match the transition contour of a firearm, in the region of the firearm frame transitioning between the thick frame and the thin trigger guard. The shield member is fitted over the trigger guard, with the trigger guard situated within the U-shaped channel. A plug is inserted through an aperture in the first plate, through the trigger guard, and through a second aperture in the second plate. The plug is secured within the shield member by a lock attached to the end of the plug protruding from the second aperture, thus preventing access to the trigger and preventing removal or substantial movement.

12 Claims, 4 Drawing Sheets

TRIGGER LOCK

RELATED APPLICATION DATA

This application claims the priority date of provisional application No. 61/533,246 filed on Sep. 11, 2011.

BACKGROUND

The field of the present device and method relates to a lock for the trigger of a firearm, and more particularly, to a trigger lock that encloses the trigger guard opening to make the trigger inaccessible.

Trigger locks that are generally disclosed in the art are used to cover the trigger guard of a firearm to prevent access to the trigger when in the locked configuration. Many of these devices have members that insert through the trigger guard opening to connect to a locking device on one or both sides of the trigger guard, such as a keyed lock, a combination lock, or the like. Trigger locking devices may be shaped to fill the area within the trigger guard opening to prevent trigger movement. However, these devices often use custom locking devices that are neither readily available nor easily replaced. What is needed is a trigger locking device that is compatible with multiple locks that are commonly available, that prevents access to the trigger when locked, permits ready access to the firearm by the owner, and prevents transport of the firearm outside a designated area by unauthorized users.

SUMMARY

The present trigger lock is an entirely new and creative design, offering significant advantages over the prior art. The trigger lock is for use with a variety of firearms with a trigger and a trigger guard surrounding the trigger that creates an opening through which a user accesses and actuates the trigger. The firearm design includes a body or a frame, where the frame is generally of a thicker dimension than the trigger guard. Thus, to transition from the thicker frame to the thinner trigger guard, a transition step is machined or otherwise formed into a standard firearm, where the step can be a sloped region with a vertical wall, inclined wall or other appropriate means to transition between areas of varying thickness. An area of increased thickness may also be created by components attached to or extending from the frame of the firearm, rather than the firearm frame itself, such as the grips and the like.

The trigger lock has a shield member with a U-shaped channel formed by the combination of a first flange or plate and a second flange or plate spaced apart from the first flange, and a web connecting the first and second flanges. The U-shaped channel can be varied in shaped to create two spaced apart flanges, such as square-bottomed "U" and other variations. The first flange has a first aperture formed through it; and the second flange has a second aperture formed through it. The trigger lock further comprises a plug that has a base portion and a shaft extending from the end of the base portion, with a lock attachment portion located on or within the shaft. The shaft is preferably, but not necessarily, sized to slip through the second aperture, but is preferably not be substantially smaller than the second aperture, to prevent undue play and so that an attached lock cannot be pulled through the second aperture. The lock attachment portion is configured to connect with a lock when in a secured and locked arrangement. Further, the shaft may be machined or molded as a single unit with the base portion or may be threaded into the base portion.

The shield member is configured to be fitted over the trigger guard of the firearm, with the trigger guard inserted between the first flange and the second flange to cover the opening of the trigger guard. The plug is designed to be inserted through the first aperture, passing through the opening in the trigger guard between the trigger guard and the trigger, and through the second aperture. The plug may be situated forward or behind the trigger, depending on how the trigger is disposed within the trigger guard, e.g., the trigger may be towards the back of the trigger guard or in the middle of the trigger guard opening. Generally, the base portion of the plug is disposed between the trigger and the trigger guard within the opening. The base portion may also be disposed between the trigger and the frame of the firearm, if the trigger guard is merged into the frame of the firearm forward or back of the trigger. Once the shield member and the plug are fitted to the trigger guard as described, a lock is secured to the lock attachment portion. When the lock is attached, the lock body size can be chosen such that it cannot fit through the second aperture, to prevent de-insertion of the plug. The shield member is configured to block access to the trigger to prevent user actuation of the trigger. Further, the shield member and plug are configured to prevent substantial movement of the shield member relative to the firearm frame.

In an alternate embodiment, the lock attachment portion is configured to receive a rotating tee locking member. The lock attachment portion here would be a slotted keyway with an undercut shelf formed distally from a keyway opening. The tee or T-shaped locking member is inserted into the slotted keyway, where the tee locking member is rotated into engagement with the undercut shelf to prevent removal of the tee locking member. Other similar locking members that can fit through the slotted keyway and rotate into engagement with the undercut shelf may be used, such as an L-shaped locking member.

In an alternate embodiment, the lock attachment portion is configured to receive a shaft retainer locking member. The lock attachment portion here would be an annular groove cut about the circumference of the shaft, such that a ferrule or raised annular portion is formed near the end of the shaft. The shaft retainer locking member has a clamshell mechanism that is open when unlocked and clamps together when locked. The shaft, which protrudes from the second aperture, is inserted within the shaft retainer locking member and the clamshell mechanism engages the annular groove to capture the ferrule to prevent removal of the shaft retainer locking member.

In an alternate embodiment, the lock attachment portion is configured to receive the shackle of a shackle locking member. The lock attachment portion here would be a through hole formed through the shaft and intersecting the axis of the shaft, where the through hole preferably is drilled through and normal to the cylindrical axis of the shaft. The free end of the shackle, such as from a padlock, is inserted into the through hole and received by the body of the shackle locking member to close and lock the shackle to prevent removal of the shaft retainer locking member. The first and second aperture may be aligned and appropriately sized to receive a shackle of a lock, with the shackle inserted through the apertures when the shield member is engaged over the trigger guard, where the shackle passes through the opening to prevent movement or removal of the trigger lock. The first and second apertures may be arranged to position the shackle immediately next to the trigger guard within the trigger guard opening.

In another alternate embodiment, the lock attachment portion is configured to receive a lock that is tethered to an immovable object by a lanyard, made from a plastic-coated metal cable or the like. In this way, the firearm cannot be moved by an unauthorized user beyond the length of the lanyard when locked. In yet another alternate embodiment, the first aperture in the first flange has a counterbore formed on the outside wall, where the plug base has a corresponding shoulder formed distally from the end and configured to be inserted within the counterbore. Alternately, at least one peripheral edge of either or both the first and second flanges is complimentarily contoured to the transition step leading from firearm body to the trigger guard, such that a peripheral edge contour closely fits a transition step contour to prevent substantial movement of the shield member relative to the trigger guard. The top peripheral edge can be complementarily contoured to a first transition step contour and a back peripheral edge can be complementarily contoured to a second transition step contour to prevent substantial movement of the shield member relative to the trigger guard in at least two directions. In yet another alternate embodiment, the base of the plug is complementarily shaped to closely fit an area bounded by and between the trigger and the trigger guard or the trigger and the frame of the firearm, such that the plug prevents substantial movement of the shield member relative to the trigger guard in at least one direction.

An alternate embodiment of the trigger lock includes a bolt in place of the plug. The bolt is configured to be inserted through the first aperture, through the opening in the firearm trigger guard, with the end of the bolt extending out of the second aperture. The bolt is shaped to prevent the bolt from being pushed through the second aperture and has a lock attachment portion formed on the end of the bolt.

In another alternate embodiment, the shield member has a peripheral contour that is complementarily shaped to match the transitional step contour, such that when the trigger guard is inserted within U-shaped channel of the shield member, the peripheral contour closely fits the transitional step contour, to prevent substantial movement of the shield member relative to the trigger guard.

Figure 1D:
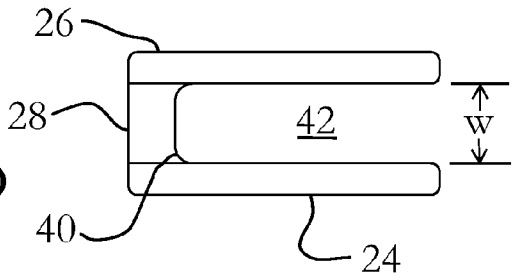
FIGS. 1A-E are orthographic views of the sides, top, and front, and a perspective view of the shield member of a preferred embodiment, showing the second flange, the web, the first flange, and the top side.
Figure 1C:
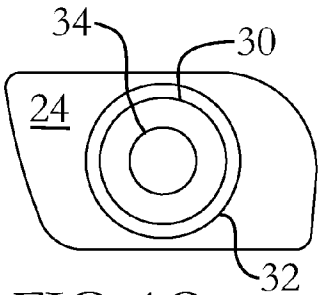
Figure 1B:
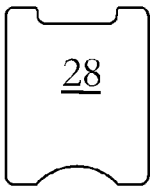
Figure 1A:
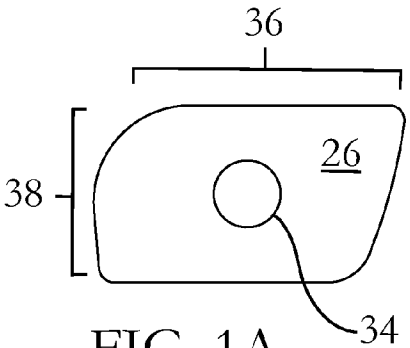

| LISTING OF REFERENCE NUMERALS of FIRST-PREFERRED EMBODIMENT | |
|---|---|
| trigger lock | 20 |
| shield member | 22 |
| first plate | 24 |
| second plate | 26 |
| web | 28 |
| first aperture | 30 |
| counterbore | 32 |
| second aperture | 34 |
| gap width | w |
| top peripheral edge contour | 36 |
| back peripheral edge contour | 38 |
| inner front wall | 40 |
| U-shaped channel | 42 |
| plug | 44 |
| base | 46 |
| shaft | 50 |
| shaft end | 52 |
| annular groove | 54 |
| ferrule | 56 |
| annular shoulder | 58 |
| plug | 60 |
| insert | 61 |
| shaft | 62 |
| shaft end | 63 |
| T-bar slot | 64 |
| undercut shelf | 66 |
| base | 68 |
| T-bar lock | 70 |
| annular shoulder | 72 |
| plug | 74 |
| shaft | 76 |
| shackle aperture | 78 |
| annular shoulder | 80 |
| base | 82 |
| firearm | 200 |
| hammer | 201 |
| firearm frame | 202 |
| trigger | 204 |
| trigger guard | 206 |
| front portion | 207 |
| opening | 208 |
| transition step | 210 |
| transition step contour | 212 |
| lock | 214 |
| lock head | 215 |
| lanyard | 218 |
| loop | 220 |
| immovable object | 222 |
| firearm | 224 |

DESCRIPTION OF THE PREFERRED EMBODIMENTS

The detailed descriptions set forth below in connection with the appended drawings are intended as a description of embodiments, and is not intended to represent the only forms in which the present trigger lock may be constructed and/or utilized. The descriptions set forth the structure and the sequence of steps for constructing and operating the trigger lock in connection with the illustrated embodiments. It is to be understood, however, that the same or equivalent structures and steps may be accomplished by different embodiments that are also intended to be encompassed within the spirit and scope of the invention.

Looking first at FIGS. 1A-E, an example embodiment of the shield member (22) is shown in several views. As will be described in further detail below, the shape and dimension of the shield member (22) varies according to the particular firearm the shield member (22) is intended to lock. The present example embodiment was made to fit a standard COLT 1911 model .45 semiautomatic pistol, designated as the M1911 series. Thus, the below described operation and embodiments have been customized to be compatible with the M1911. However, with only slight modification of shape and dimension, the present trigger lock (20) can be used to secure a variety of firearms, including automatic pistols, revolvers, assault rifles, long rifles, shotguns, and the like.

Figure 1E:
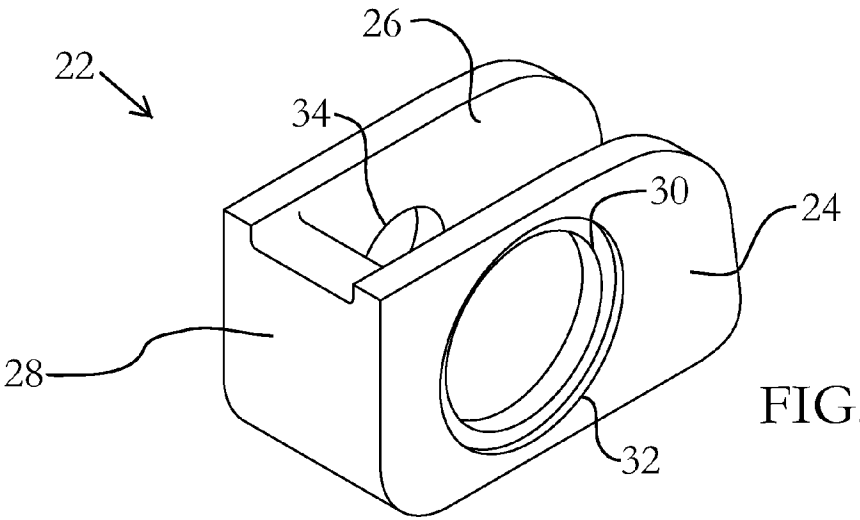
Figure 6A:
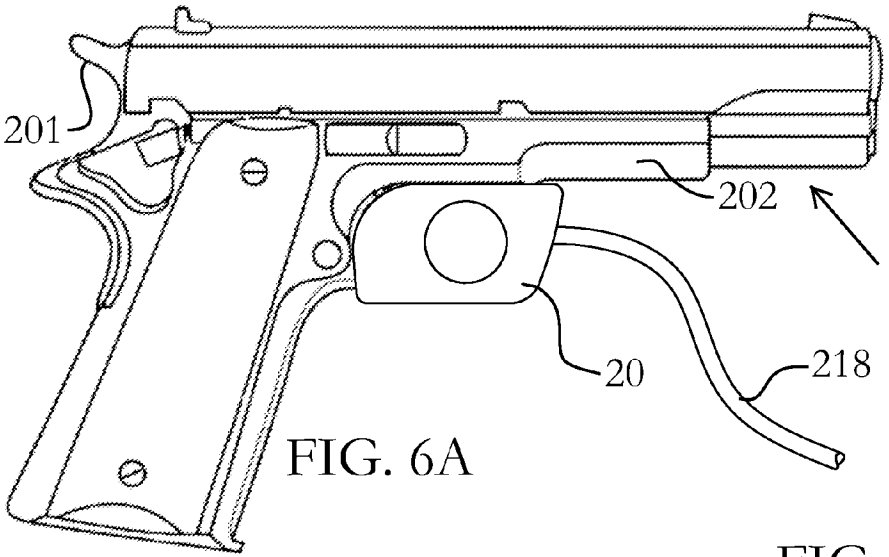
FIG. 6A is a side planar view of an example firearm showing the present trigger lock secured to the trigger guard.

The shield member (22) is shown in front perspective, with the web (28) towards the viewer in FIG. 1E. It is shown in FIG. 6A, that preferably the web (28) is closest to the muzzle of the firearm (200) when the trigger lock (20) is engaged over the trigger guard (206). Thus, when referencing the front or forward direction, this refers to the muzzleward direction, relative to the firearm (200). Similarly, when referencing the back or rear direction, this would be opposite of the muzzleward direction, towards the breech of the firearm. Since the trigger lock (20) is configured to install over the trigger guard (206) of the firearm (200) to cover the trigger (204), the trigger lock (20) would be positioned under the barrel of the firearm (200) when the firearm (200) is gripped by the handle in the traditional firing position with the butt end of the handle facing towards the ground. Thus, when referencing the top or upward portion of the trigger lock (20), this would be the portion of the shield member (22) that lies closest to the barrel when installed over the trigger guard (206).

FIG. 1E shows the construction of the shield member (22), with a first plate (24) connected with a second plate (26) through a web (28) that faces the muzzleward direction when the shield member (22) is installed on the firearm (200). The basic design of the shield member (22) is such that the opening (208) of the trigger guard (206) is completely covered from both sides of the trigger guard (206), so that the trigger (204) is made inaccessible. Although the web (28) is shown extending between the first plate (24) and second plate (26) along the entire height of the front side of the shield member (22), the web (28) may be designed to extend less than this height or any appropriate dimension. Essentially, once installed on the trigger guard (206), the trigger guard (206) is enclosed, in whole or in part, on at least three sides. In this embodiment, the first plate (24) and the second plate (26) are planar and parallel to one another to match the profile of the trigger guard (206), but may be shaped differently and be nonparallel if required by a specific application. The space or gap width (w) between the first plate (24) and the second plate (26) is sufficiently wide to slide over the trigger guard (206), but should not be excessively wide such that the trigger may be accessed by applying a lateral force to move the shield member (22). The inner boundary formed by combination the first plate (24), the second plate (26), and the web (28) creates a U-shaped channel (42) that surrounds the trigger guard (206) on at least three sides.

In order to receive the bolt or plug (44, 60, or 74), a first aperture (30) is drilled through the first plate (24) at a preferred angle that is normal to the plane of the first plate (24). A counterbore (32) may be drilled to receive a shoulder portion (58, 72, or 80) of the plug (44, 60, or 74), as will be discussed below. A second aperture (34) is drilled through the second plate (26), again, normal to the plane of the plate (26). Although, the first aperture (30) and the second aperture (34) are shown as being concentric, they may be drilled on eccentric axes. Further, the first aperture (30) and the second aperture (34) are shown as round holes, but may be milled in oblong, poly-sided, or other shape required by the profile shape of the plug (44, 60, or 74).

The shield member (22) has a top peripheral edge contour (36) and a back peripheral edge contour (38) that are shown as being a curved or splined peripheral edge. This design is specific and customized to fit the shape and ledges of the transition step contour (212) to prevent movement of the shield member (22) in the upward and/or rearward directions. These curves may vary from linear to curvilinear to closely match the shape of the firearm body or frame (202) in the immediate vicinity surrounding and near the trigger guard (206). The shield member (22) may be machined or molded from any appropriately tough material, such as polycarbonate or aluminum.

Figure 2:
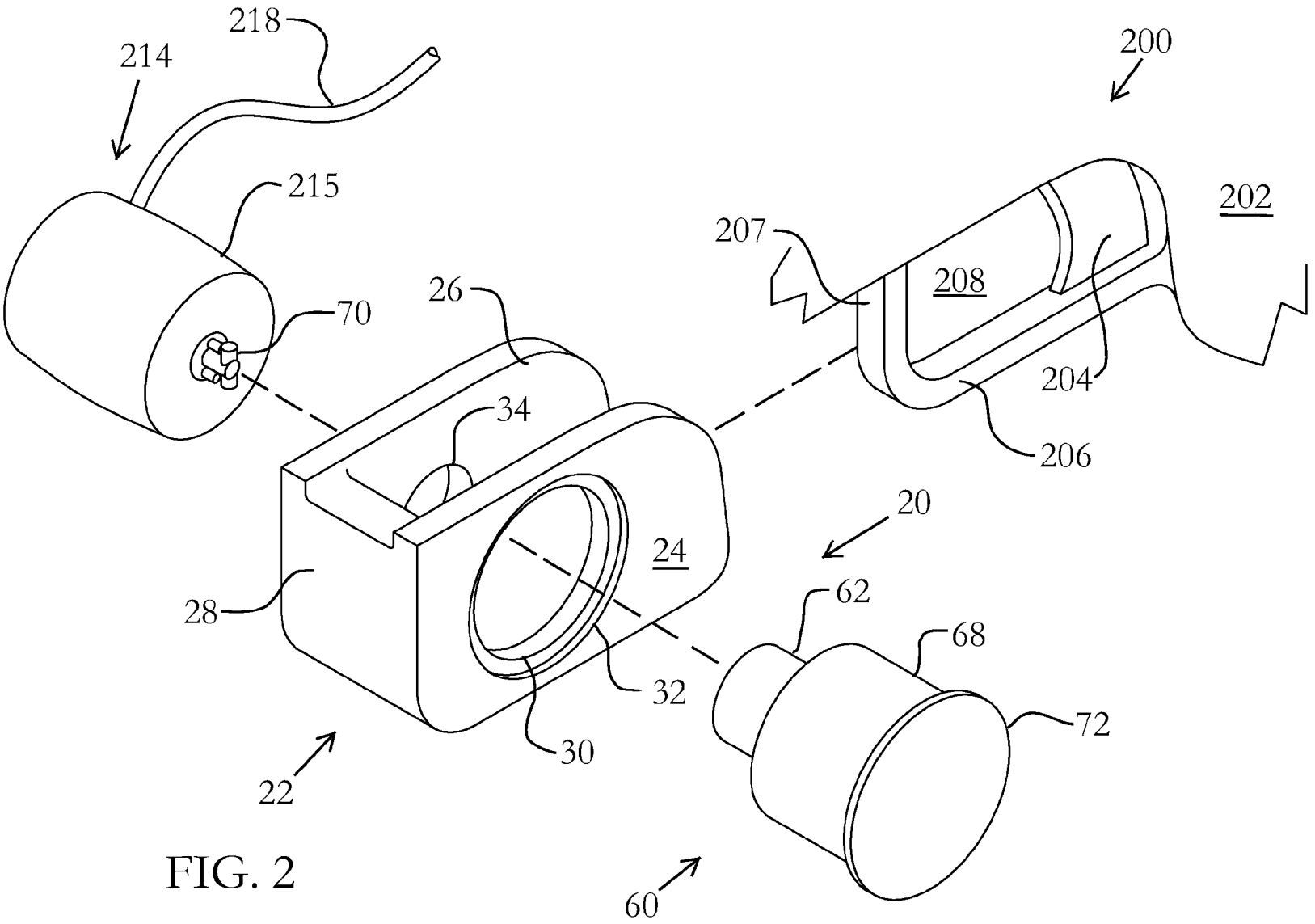
FIG. 2 is an exploded perspective view of the trigger lock, showing how the shield member is arranged to be fitted over the trigger guard, and how the plug is arranged to be inserted through the apertures of the shield member to secure the trigger lock to the trigger.
Figure 5A:
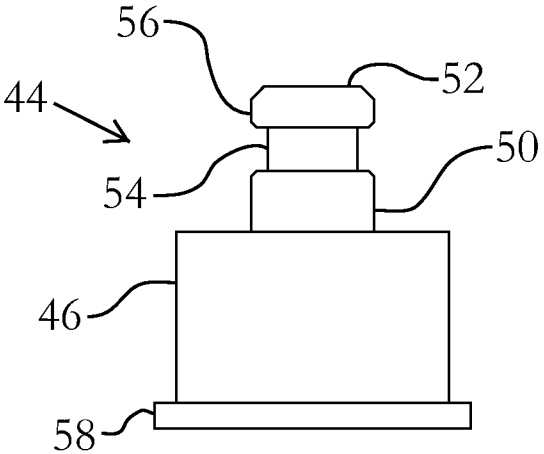
FIGS. 5A-B are side and top planar views of the plug of a preferred embodiment, showing the shaft retainer locking member compatible version of the lock attachment portion.
Figure 5B:
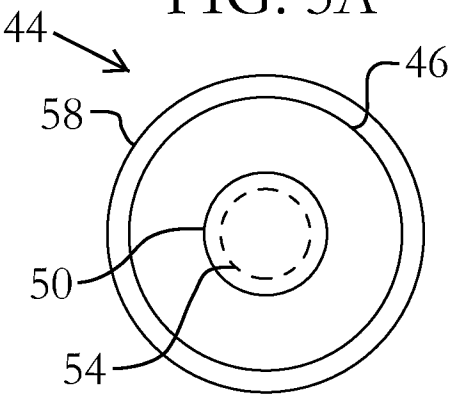

Turning now to FIG. 2, an exploded assembly of the present trigger lock (20) is shown, with the trigger guard (206) of the firearm (200) and lock (214) as part of the exploded assembly. The bolt or plug (60) has a base (68), with an annular shoulder (72) at one end and a shaft (62) at the opposite end. The shield member (22) is installed over the trigger guard (206), with the front portion (207) preferably abutting against or is closely situated to the inner front wall (40) of the web (28) within the U-shaped channel (42), although this is not required in all embodiments. After the shield member (22) is installed over the trigger guard (206), as shown in FIGS. 6A-B, the plug (60) is inserted through the first aperture (30), with the annular shoulder (72) resting within the counterbore (32). The counterbore (32) permits the annular shoulder (72) of the plug (60) to rest flush within the counterbore (32), although this is not required. The shaft (62) in this example projects though the second aperture (34), extending out from the second plate (26). A lock attachment portion, which varies as shown in FIGS. 3-5, is located on the shaft (62) that is configured to receive and interlock with the lock (214) and to hold the lock body (215) in close proximity with the second plate (26). In this way, the shoulder (72) prevents movement of the plug (60) in the direction of further insertion and the lock body (215) prevents de-insertion of the plug (60), due to both bodies being too large to enter their respective apertures (30 and 34). It is understood that the present trigger lock (20) can be modified with various shoulder and alternative plug designs to achieve similar results.

The first aperture (30) and the second aperture (34) are positioned to align with the area (208) bounded between the trigger (204) and the inside of the trigger guard (206) when the shield member (24) is installed over the trigger guard (206), this is so the inserted plug (60) can transverse and pass through area (208). Although the plug (60) is shown with a cylindrical base (68), the shape may be modified to closely fit the shape created by the bounds of area (208), so that the base (68) is prevented from substantially moving within the area (208), thus similarly restricting movement of the shield member (22). Alternatively, the base (68) of the plug (60) may have a profile that is smaller than area (208), yet being positioned forward to place the base (68) in close proximity of the trigger guard (206), thus closely capturing the front portion (207) of the trigger (206) between the base (68) and the web (28) to prevent substantial movement of the shield member (22).

Figure 3A:
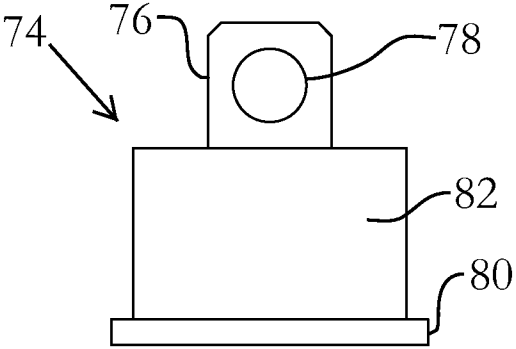
FIGS. 3A-B are side and top planar views of the plug of a preferred embodiment, showing the shackle compatible version of the lock attachment portion.
Figure 3B:
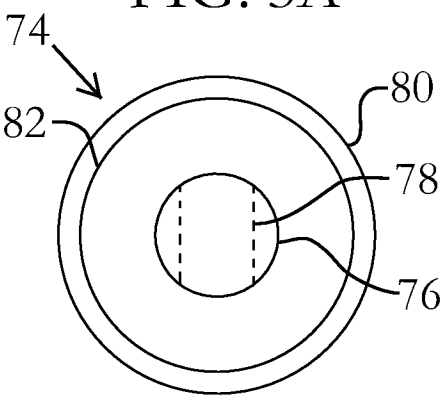

Several design variations of the present plug are seen in FIGS. 3-5, each being configured to couple with a different type of lock. First, as shown in FIGS. 3A-B, the plug (74) has a base (82) and an annular shoulder (80). The shaft (76) has a shackle aperture (78), which is a through hole drilled transversely through the cylindrical axis of the shaft (76). A standard shackle of a padlock or other similar lock can be inserted through the shackle aperture (78) when the plug (74) is inserted within the shield member (22). In this way, the shackle and connected lock prevent de-insertion of the plug (74). Alternatively, other locking means may be inserted through the shackle aperture (78), such as a cable or lanyard (218), which is looped about a weighted or immovable object (222).

Figure 4A:
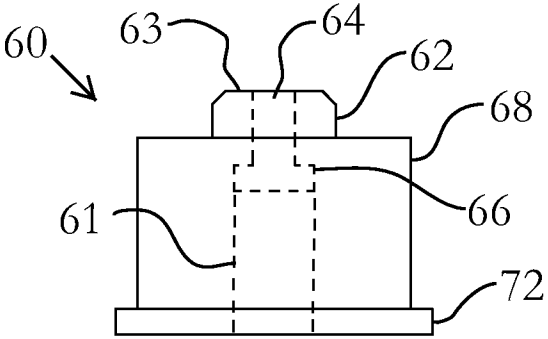
FIGS. 4A-B are side and top planar views of the plug of a preferred embodiment, showing the tee locking member compatible version of the lock attachment portion.
Figure 4B:
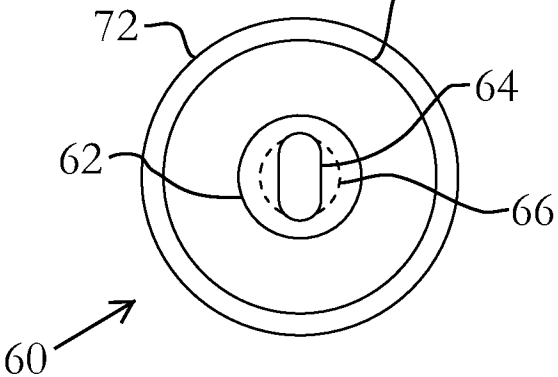

Yet another alternate embodiment of the plug is shown in FIGS. 4A-B, where the plug (60) is configured to be compatible with lock (214) that has a T-shaped rotating tee locking member or T-bar lock (70) (shown in FIG. 2). This lock product is made by KENSINGTON and is known as the MICROSAVER lock, which is disclosed in U.S. Pat. Nos. 6,081,974, 6,317,936; 6,360,405, 7,204,106, 7,409,842 and U.S. App. Nos. 2011/0179834 and 2011/0122551. This type of lock is designed to work with a standard slot formed in the cases of laptops, to secure the laptop by a tether to a table or the like, using attachment device as in some of above mentioned patents.

The locking member is shown as being T-shaped, but may be L-shaped or other appropriately shaped member. The base (68) has an annular shoulder (72) at a first end and a shaft (62) at the opposite end. Milled parallel to the cylindrical axis of the shaft (62), a slotted keyway or T-bar slot (64) is formed through the shaft end (63). An undercut shelf (66) is formed at a depth, by drilling a hole from the end of the plug (60) opposite from the T-bar slot, then plugging the hole with insert (61) which is threaded, glued, brazed, or fastened within the plug (60) to make the insert (61) immovable. The T-bar slot (64) is configured to receive the T-bar lock (70) of the lock (214). Once the T-bar lock (70) is fully inserted within the T-bar slot (64), the T-bar lock (70) is rotated 90 degrees, so that the T portion rotates underneath the undercut shelf (66). The undercut shelf (66) captures the T portion beneath the shelf to prevent the T-bar lock (70) from being removed. To remove the T-bar lock (70), a key is inserted into the lock (214) to rotate the T portion out of engagement with the undercut shelf (66). The internal details of the undercut shelf (66) and the T-bar slot (64) are shown with hidden lines in both FIGS. 4A and 4B. The T-bar lock (70) is shown in a simplified form, with two pins that extend from the lock (215) on both sides of the T to prevent the T-bar lock (70) from being rotated out of the T-bar slot (64).

In yet another alternate embodiment, plug (44) is shown with base (46) having an annular shoulder (58) at one end and a shaft (50) at the other end. The shaft (50) has an annular groove (54) formed slightly away from the shaft end (52), leaving a ferrule (56) at the shaft end (52). This plug (44) design is configured to connect with a shaft retainer locking member lock with an internal clamshell gripping means that pinches down on the shaft within the annular groove (54), to capture the ferrule (56) within the jaws of the clamshell gripper. This type of lock is sold by KENSINGTON and is known as the CLICKSAFE lock, which is also disclosed in U.S. Pat. Nos. 7,730,751, 7,963,132, 7,997,106, 8,001,812, 8,042,366, 8,230,707, U.S. App. Nos. 2012/0125057 and 2011/0072863, and U.S. Des. Pat. Nos. D651,889, D660,682, and D661,975. The shaft (50) can be machined or molded as part of the base (46) from a single material; or the shaft may be machined separately and threaded, pressed, brazed, or the like within the base (46).

Figure 6C:
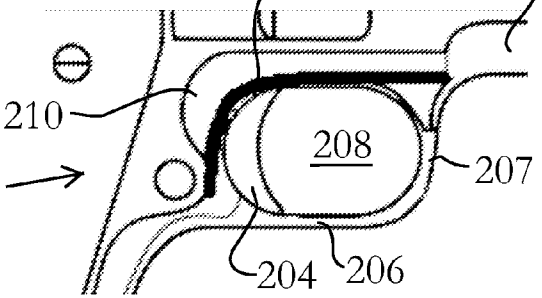
FIG. 6C is a magnified planar side view of the example firearm, showing the transition step.
Figure 6D:
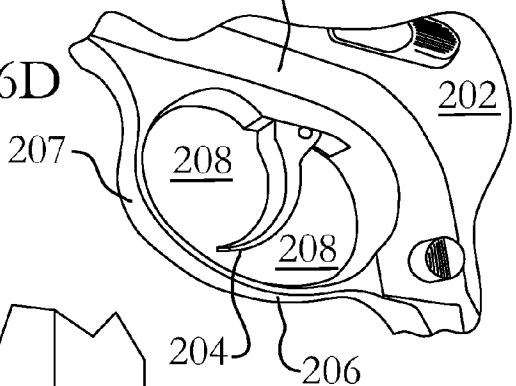
FIG. 6D is a magnified perspective view of the an alternate example firearm, showing the transition step.
Figure 6B:
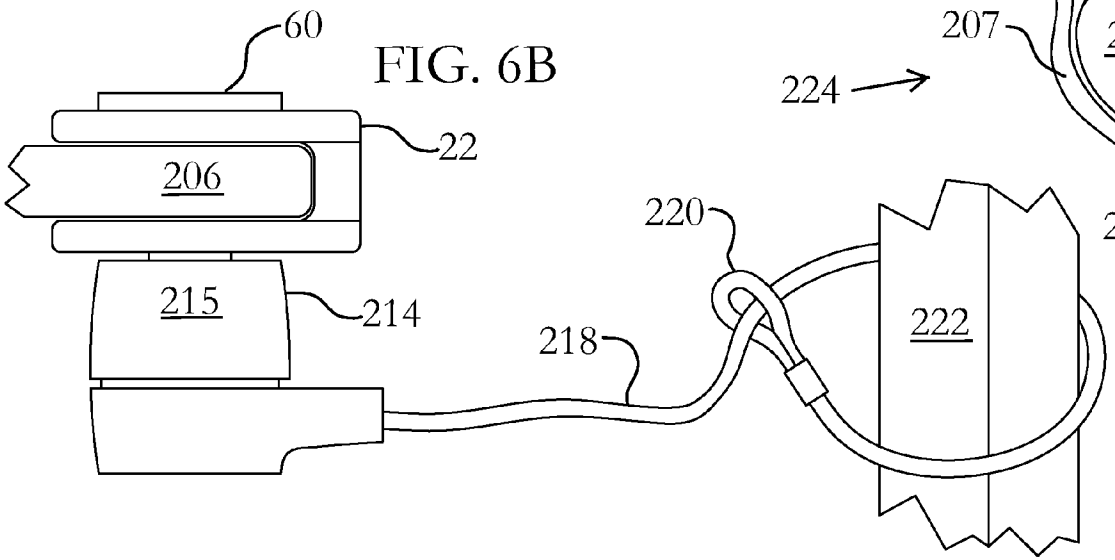
FIG. 6B is a magnified bottom planar view of the trigger lock installed on the example firearm trigger guard, with the lock tethered to an immovable object by a lanyard.

FIGS. 6A-D show an example firearm (200) and various views of the trigger lock (20) installed on the firearm (200). Many types of firearms have a body or frame (202) that is thicker than the trigger guard (206). To transition from the thick frame (202) to the thinner trigger guard (206) area, one or more transition areas or transition steps (210) are required to slope down or step down from the thicker frame (202) to the thinner trigger guard (206). Because the firearm (200) is ergonomically sculpted for function, comfort, and beauty, the transition step (210) is often non-constant, where the transition step (210) may be linear in some portions and curvilinear in other portions. This change in thickness is advantageously used to prevent movement of the shield member (22), since the top peripheral edge contour (36) and the back peripheral edge contour (38) have contoured peripheral edges that substantially match the transition step contour (212) of the firearm (200). The transition step contour (212) is shown with a bolded line in FIG. 6C. Since the width (w) of the U-shaped channel (42) of shield member (22) is designed to closely match the thickness of the trigger guard (206), the transition step (210) prevents rearward and upward movement of the shield member (22). When the plug (60) is inserted through the shield member (22), the base (68) of the plug (60), the top peripheral edge contour (36), and the back peripheral edge contour (38) will contact their respective portions of the transition step (210) to prevent movement of the shield member (22) relative to the firearm (200). FIG. 6D shows an alternate firearm (224) that is additionally compatible with the present trigger lock (22). In the shown firearm (224), the trigger (204) is disposed within the middle of the opening (208), such that portions of the opening (208) are situated both in front of and behind the trigger (204). The plug (44, 60, or 74) can be positioned either in front or behind the trigger (204) within the opening (208).

To lock a firearm (200) with the present trigger lock (20), a preferred method of locking would include removing the ammunition magazine or clip, inspecting the chamber to insure no round is present, drawing back or cocking the hammer (201), sliding the shield member (22) over the trigger guard (206), inserting the plug (60) through the apertures of the shield member (22), attaching a lock (214) to the shaft (62) of the plug (60), locking the lock (214) so that the lock head (215) prevents de-insertion of the plug (60). The plug (82) shown in FIG. 3A-B is compatible with the same method, except a shackle of a common padlock (not shown) is inserted through the shackle aperture (78). Additionally, the plug (46) shown in FIG. 5A-B is compatible with the same method, except the clamshell mechanism of the shaft retainer locking member engages the annular groove (54) to capture the ferrule (56) to lock it in place. A cable or lanyard (218) can be attached to any portion of the lock (214) or any portion of the trigger lock (20) by one end and secured to a heavily weighted or an immovable object (222) by the opposite end, perhaps wrapped about the object (222) and threaded through a loop (220) as shown in FIG. 6C. The immovable object may be a heavily weighted object, such as a or dresser frame, or may be a permanent structure, such being attached to the wall of a home.

The present trigger lock (20) uses common locking means to secure the firearm (200) to a chosen location and prevents unauthorized actuation of the trigger. Since many firearms (200) will maintain the hammer (201) in the cocked position until the trigger (204) is actuated, the trigger lock (20) cannot be defeated by manually cocking and releasing the trigger to fire the weapon. Not until the trigger lock (20) is removed, may the hammer (201) be released and readied for firing. The adaptation of the interchangeable plug design to the MICROSAVER and CLICKSAFE lock products, or padlocks permits the purchase of locks from the local electronic or office supply store. A further advantage is the ability to tether the firearm (200) to the frame of a bed or other similar appliance or furniture piece, so that the firearm (200) is readily accessible in an emergency, yet securely and safely stored. Yet another advantage of the present trigger lock (20) is the ability to purchase multiple common computer locks, such that the owner can easily transport the firearm (200) from one location to the next, where each location has a similarly keyed lock tethered to an immovable object (222) so that the firearm (200) can be secured at each location.

While particular forms of the present trigger lock have been illustrated and described, it will also be apparent to those skilled in the art that various modifications can be made without departing from the spirit and scope of the design. Accordingly, it is not intended that the invention be limited except by the claims.

What is claimed is:

1. A trigger lock for use with a firearm having a firearm body, a barrel, a trigger, a handle behind the trigger, and a trigger guard with an opening surrounding the trigger, the trigger guard having a front portion closest to a firearm muzzle and extending downward and away from the barrel, the trigger guard having a bottom portion furthest from the barrel, the firearm having a transition step leading from firearm body to the trigger guard where the transition step delineates a decrease in cross sectional thickness from the firearm body to the trigger guard, the transition step having a top transition step contour closest to the barrel and a back transition step contour closest to the handle, the trigger lock configured to receive a lock, the trigger lock comprising:

a shield member comprising a first flange, a second flange spaced apart from the first flange, and a web connecting the first flange to the second flange, the first flange having a top edge and a back edge;

a first aperture being formed through the first flange and a second aperture being formed through the second flange; and a plug with a base having a shaft extending from an end of the base, the shaft having a lock attachment portion;

wherein the shield member is configured for engagement over the trigger guard, with the trigger guard inserted between the first flange and the second flange to cover the opening of the trigger guard;

and wherein, when engaged, the web is configured to cover just the front portion of the trigger guard leaving the bottom portion of the trigger guard exposed;

and wherein the plug is configured to be inserted through the first aperture, passing through the opening in the trigger guard between the trigger guard and the trigger, and through the second aperture, the base of the plug being positioned closely adjacent to the front of the trigger guard such that the front of the trigger guard is closely bound between the web and the base;

and wherein the top edge of the first flange contacts the top transition step contour to substantially prevent movement of the shield member in an upward direction towards the barrel, the back edge of the first flange contact the back transition step contour to substantially prevent movement of the shield member in a rearward direction towards the handle;

and wherein the lock attachment portion is configured to receive a lock, the lock once attached being sized to prevent de-insertion of the plug, the shield member blocking access to the trigger preventing user actuation of the trigger.

2. The trigger lock of claim 1 wherein the lock attachment portion is configured to receive a rotating tee locking member.

3. The trigger lock of claim 2 wherein the lock attachment portion is a slotted keyway with an undercut shelf formed distally from a keyway opening, whereby the tee locking member is inserted into the slotted keyway and then the tee locking member is rotated into engagement with the undercut shelf to prevent removal of the tee locking member.

4. The trigger lock of claim 1 wherein the lock attachment portion is configured to receive a shaft retainer locking member.

5. The trigger lock of claim 4 wherein the lock attachment portion is an annular groove formed about the circumference of the shaft such that a ferrule is formed near the end of the shaft, whereby a clamshell mechanism of the shaft retainer locking member engages the annular groove to capture the ferrule to prevent removal of the shaft retainer locking member.

6. The trigger lock of claim 1 wherein the lock attachment portion is configured to receive a shackle locking member.

7. The trigger lock of claim 6 wherein the lock attachment portion is a through hole intersecting the axis of the shaft, whereby the shackle is inserted through the through hole and received by the shackle locking member to close and lock the shackle to prevent removal of the shaft retainer locking member.

8. The trigger lock of claim 1 wherein the first aperture and the second aperture are sized and aligned to receive a shackle of the lock, with the shackle inserted through the first aperture and the second aperture when the shield member is engaged over the trigger guard, the shackle passing through the opening.

9. The trigger lock of claim 1 wherein the lock attachment portion is configured to receive a lock that is tethered to an immovable object by a lanyard, wherein the firearm cannot be moved beyond the reach of the lanyard when locked.

10. The trigger lock of claim 1 wherein the first aperture in the first flange has a counterbore formed on an outside wall, the base having a shoulder situated distally from the end configured to be inserted within the counterbore.

11. The trigger lock of claim 1 wherein the top edge is complementarily contoured to the top transition step contour and the back peripheral edge is complementarily contoured to the back transition step contour to prevent substantial movement of the shield member relative to the trigger guard in at least two directions.

12. The trigger lock of claim 1 wherein the base of the plug is complementarily shaped to closely fit an area bounded by and between the trigger and the trigger guard, whereby the plug prevents substantial movement of the shield member relative to the trigger guard in at least one direction.

* * * * *